US006790162B1

(12) United States Patent
Ellis et al.

(10) Patent No.: US 6,790,162 B1
(45) Date of Patent: Sep. 14, 2004

(54) RECUMBENT STEPPER WITH INDEPENDENTLY MOVABLE UPPER AND LOWER BODY LEVER ARRANGEMENTS

(75) Inventors: Patrick D. Ellis, Oak Creek, WI (US); Fred A. Malicki, Wauwatosa, WI (US)

(73) Assignee: Northland Industries, Inc., South Milwaukee, WI (US)

( * ) Notice: Subject to any disclaimer, the term of this patent is extended or adjusted under 35 U.S.C. 154(b) by 275 days.

(21) Appl. No.: 09/943,220

(22) Filed: Aug. 30, 2001

(51) Int. Cl.[7] ..... A63B 21/00; A63B 69/06
(52) U.S. Cl. ..... 482/51; 482/52; 482/62
(58) Field of Search ..... 482/51, 52, 53, 482/57, 62, 70–73

(56) References Cited

U.S. PATENT DOCUMENTS

| | | | | |
|---|---|---|---|---|
| 326,247 A | * | 9/1885 | Root | 482/56 |
| 5,031,900 A | | 7/1991 | Leask | |
| 5,242,351 A | | 9/1993 | Berg et al. | |
| 5,445,583 A | | 8/1995 | Habing | |
| 5,505,679 A | | 4/1996 | McBride et al. | |
| 5,514,053 A | | 5/1996 | Hawkins et al. | |
| 5,527,250 A | | 6/1996 | Chen | |
| 5,569,126 A | | 10/1996 | Perussi et al. | |
| 5,810,696 A | | 9/1998 | Webb | |
| 5,992,253 A | | 11/1999 | Petersen | |
| 6,042,518 A | | 3/2000 | Hildebrandt et al. | |
| 6,080,088 A | | 6/2000 | Petersen et al. | |

* cited by examiner

*Primary Examiner*—Stephen R. Crow
(74) *Attorney, Agent, or Firm*—Andrus, Sceales, Starke & Sawall, LLP

(57) ABSTRACT

A recumbent stepper is provided for exercising the lower body and the upper body and includes a frame and a seat attached to the frame. First and second lower body lever arrangements are pivotally coupled to the frame to move in first and second opposite directions and are adapted to be engaged by an exerciser's feet. First and second upper body lever arrangements are pivotally coupled to the frame to move in the first and second directions and are adapted to be engaged by the exerciser's arms. A resistance structure is commonly connected to each of the lever arrangements for resisting pivoting movement of each lever arrangement in one of the first and second directions. Motion transfer structure is mounted on the frame and coupled to each of the lever arrangements and the resistance structure for enabling independent movement of each lever arrangement relative to the remaining lever arrangements.

14 Claims, 7 Drawing Sheets

RECUMBENT STEPPER WITH INDEPENDENTLY MOVABLE UPPER AND LOWER BODY LEVER ARRANGEMENTS

FIELD OF THE INVENTION

This invention relates generally to exercise equipment for strengthening muscles and providing cardiovascular conditioning. More particularly, the invention pertains to a recumbent stepper for permitting selective exercising of the upper and lower body while the exerciser maintains a reclined position.

BACKGROUND OF THE INVENTION

U.S. Pat. No. 5,505,679 issued Apr. 9, 1996 to McBride discloses a recumbent exercising apparatus which includes a pair of foot levers, a pair of arm levers and a seat in which an exerciser may sit while pushing foot levers with his feet and arm levers with his arms. Movement of the foot levers and arm levers are synchronized or coupled together so as to provide a rhythmic exercise. A first linkage system couples the first foot lever, the first arm lever and a first resistance device, preferably in the form of a hydraulic cylinder, such that the resistance device resists the first foot lever and the first arm lever when they are pivoted in opposite directions. A second linkage system couples the second foot lever, the second arm lever and a second resistance device such that the second resistance device resists pivoting of the second foot lever and second arm lever when they are moved in opposite directions.

U.S. Pat. No. 6,042,518 issued Mar. 28, 2000 to Hildebrandt et al. discloses a recumbent total body exerciser having a frame, a seat supported by the frame, a pair of leg assemblies pivotally coupled to the frame about a pivot axis, and a pair of arm assemblies pivotally coupled to the frame about the same pivot axis. The left leg assembly is coupled to the right arm assembly enabling movement therewith to define a first connected assembly. Also, the right leg assembly is coupled to the left arm assembly to define a second connected assembly. The connected assemblies are coupled by a stiff mechanical linkage to a cam such that forward movement of one of the connected assemblies results in a rearward movement of the other of the connected assemblies. A first belt is coupled to a cam and a first one-way clutch wherein the cam is actuated by the stiff linkage in a first direction, and the first belt is actuated by the cam with the first belt rotating the first one-way clutch. A second belt is coupled to the cam and a second one-way clutch wherein the cam is actuated by the stiff linkage in a second direction and the second belt is actuated by the cam, the second belt rotating the second one-way clutch. The first and second one-way clutches are coupled with a pulley which is further connected to a resistance device by a third belt.

Although both of the exercise machines described above perform satisfactorily for their intended purpose, there remains a need for a recumbent total body exercise machine having upper and lower body lever arms which are not tied together for synchronized movement. Accordingly, it is desirable to provide a recumbent stepper having a set of four independent levers which are coupled to a resistance device in such a way that each lever may be used by itself or in any combination with the remaining levers.

SUMMARY OF THE INVENTION

It is a general object of the present invention to provide a recumbent stepper for exercising the upper and lower body in a variable manner.

It is one object of the present invention to provide a recumbent stepper which employs a series of four one-way clutches to provide independent movement of lower body levers and upper body levers.

It is also an object of the present invention to provide a recumbent stepper having a motion transfer system for enabling pivoting of a pair of lower body levers about two axes at the front of the stepper, and pivoting of a pair of upper body levers about a third axis at the rear of the stepper.

It is another object of the present invention to provide a recumbent stepper which is familiar to use and simulates the coordinated arm and leg movement used during walking or running.

It is an additional object of the present invention to provide a recumbent stepper which has adjustable resistance levels, is easy to use and may be mass produced at a reasonable cost.

In one aspect of the present invention, a recumbent stepper is provided for exercising the lower body and the upper body. The stepper includes a frame, a seat attached to the frame, and first and second lower body lever arrangements pivotally coupled to the frame to move in first and second opposite directions and adapted to be engaged by an exerciser's feet. First and second upper body lever arrangements are pivotally coupled to the frame to move in the first and second directions and are adapted to be engaged by an exerciser's arms. A resistance structure is commonly connected to each of the lever arrangements for resisting pivoting movement of each lever arrangement in one of the first and second directions. A motion transfer structure is mounted on the frame and coupled to each of the lever arrangements and the resistance structure for enabling independent movement of each lever arrangement relative to the remaining lever arrangements.

The lower body lever arrangements are provided with stop structure for limiting movement in the first and second directions. A spring is connected between each lower body lever arrangement and the frame to return each lower body lever arrangement in the second direction. The frame includes a pair of spaced apart vertical support plates extending substantially longitudinally along the length thereof. The lower body lever arrangements are pivotally coupled to the frame about first and second pivot axes extending transverse to the frame at a forward end thereof. The upper body lever arrangements are pivotally coupled to the frame about a third pivot axis parallel to and rearwardly of the first and second pivot axes and located beneath the seat. The motion transfer structure includes a main pulley mounted for rotation about the first pivot axis on each side of the frame at the forward end thereof. A generator pulley is mounted for rotation on a shaft passing through the frame and defining a fourth pivot axis located upwardly and rearwardly of the third pivot axis, the generator pulley being operably connected to the resistance structure. A driven pulley is mounted for rotation on the shaft on each side of the generator pulley and provided with a one-way clutch therein, each driven pulley being connected to one of the main pulleys. A driven gear is mounted for rotation on the shaft on each side of the generator pulley between the generator pulley and one of the driven pulleys and provided with a one-way clutch therein. Each of the upper body lever arrangements has a driven gear in meshing engagement with one of the driven gears. The motion transfer structure includes a separate one-way clutch associated with each of the lower body and upper body lever arrangements.

In another aspect of the invention, a recumbent stepper has a frame, a seat mounted on the frame, lower body and upper body lever arrangements pivotally coupled to the frame to move in first and second directions and resistance structure for resisting movement of the lever arrangements in one of the first and second directions. The invention is improved by a generator pulley mounted for rotation about a shaft passing through the frame and operably connected to the resistance structure. A driven pulley is mounted for rotation on the shaft on each side of the generator pulley and provided with a one-way clutch therein, each driven pulley being operably connected with one of the lower body lever arrangements. A driven gear is mounted for rotation on the shaft on each side of the generator pulley between a generator pulley and one of the driven pulleys, and provided with a one-way clutch therein, each driven gear being operably connected with one of the upper body lever arrangements. Movement of each lower body lever arrangement in the first direction causes the driven pulley to rotate on the shaft such that the one-way clutch inside the driven pulley will cause the shaft to rotate turning the generator pulley which is attached to the resistance structure, and the movement of the lower body lever arrangement in the second direction prevents rotation of the shaft due to the one way clutch inside the driven pulley. Movement of each upper body lever arrangement in the first direction causes rotation of the driven gear on the shaft such that the one way clutch inside the driven gear will cause the shaft to rotate turning the generator pulley which is attached to the resistance structure, and movement of the upper body lever arrangement in the second direction prevents rotation of the shaft due to the one-way clutch inside the driven gear.

In yet another aspect of the invention, a recumbent stepper includes a frame, a seat attached to the frame, first and second lower body lever arrangements pivotally coupled to the frame about respective, spaced apart first and second pivot axes located forwardly of the seat to move in first and second directions. First and second upper body lever arrangements are pivotally coupled to the frame about a third pivot axis beneath the seat to move in the first and second directions. A pair of main pulleys are included, each being mounted for rotation about the first pivot axis at a forward end of the frame. A generator pulley is mounted for rotation about a fourth pivot axis located upwardly and rearwardly of the third pivot axis. A pair of driven pulleys is provided, one being mounted on each side of the generator pulley about the fourth pivot axis, each driven pulley having a one-way clutch installed therein. A pair of drive belts is provided wherein each is entrained about one of the main pulleys and one of the driven pulleys on each side of the generator pulley for transferring motion from the lower body lever arrangements to the generator pulley. A pair of driven gears is provided wherein each is mounted for rotation about the fourth pivot axis between the generator pulley and one of the driven pulleys, each of the driven gears having a one-way clutch installed therein. Each of the upper body lever arrangements includes a main drive gear mounted for rotation about the third pivot axis and in meshing engagement with one of the driven gears. A resistance structure is provided for resisting pivoting movement of each of the lever arrangements in one of the first and second directions. A generator belt is wrapped around the generator pulley and the resistance structure. With this construction, each of the lever arrangements is enabled to be moved independently or in any combination with the remaining lever arrangements.

Various other objects, features and advantages of the invention will be made apparent from the following description taken together with the drawings.

BRIEF DESCRIPTION OF THE SEVERAL VIEWS OF THE DRAWINGS

The drawings illustrate the best mode present and contemplated in carrying out the invention.

In the drawings.

DETAILED DESCRIPTION OF THE INVENTION

Figure 1:
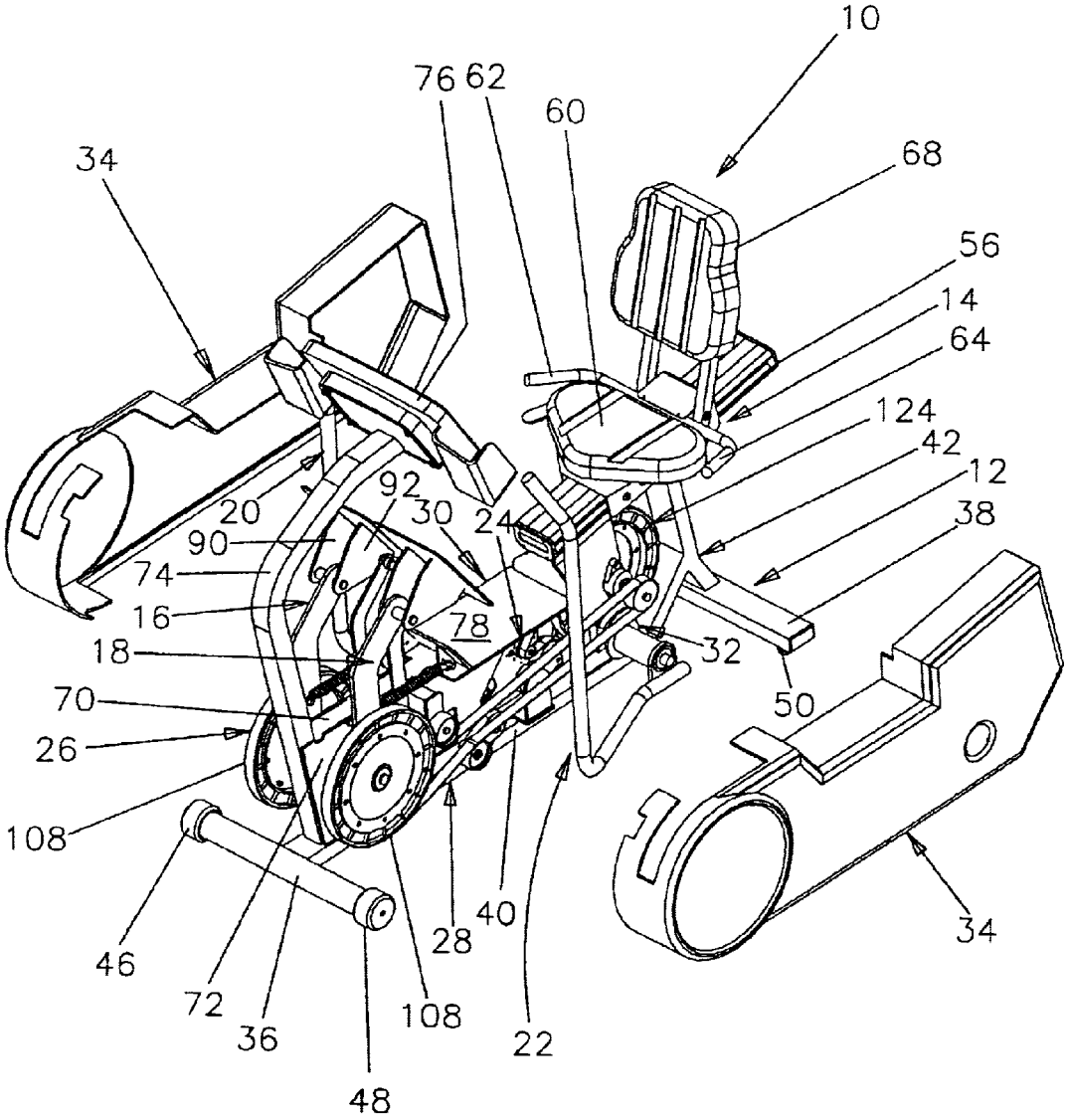
FIG. 1 is a perspective view of a recumbent stepper embodying the present invention and provided with a pair of lower body lever arrangements and a pair of upper body lever arrangements.

Referring now to FIG. 1, a recumbent stepper 10 for providing muscular and cardiovascular conditioning of the lower body and the upper body comprises a frame 12, a seat 14 adjustably secured to the frame 12, right and left lower body lever arrangements 16, 18 pivotally joined to the frame 12, right and left upper body lever arrangements 20, 22 pivotally mounted to the frame 12, a single resistance structure 24 commonly connected to each of the lever arrangements 16, 18, 20, 22, right and left, lower body motion transfer systems 26, 28 operably connecting the lower body lever arrangements 16, 18 and the resistance structure 24, and right and left, upper body motion transfer systems 30, 32 operably connecting the upper body lever arrangements 20, 22 and the resistance structure 24. Generally, all the major components of the stepper 10 are enclosed by a housing 34 that prevents inadvertent contact with the exerciser or the exerciser's clothing during use of the stepper 10.

Figure 2:
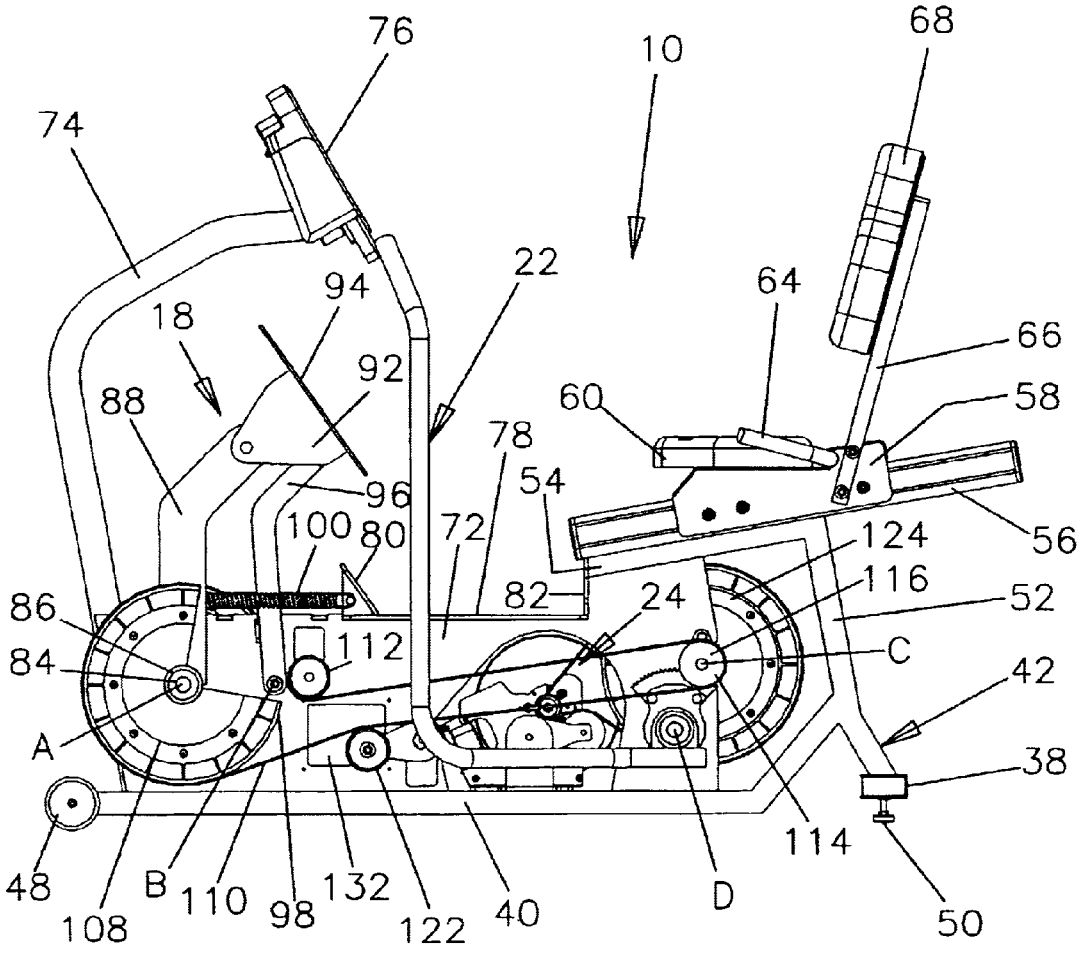
FIG. 2 is a front elevational view of the stepper shown in FIG. 1.

Referring to FIGS. 1 and 2, frame 12 includes a front transverse member 36, a rear transverse member 38 and a longitudinally extending member 40 which extends linearly and rearwardly from the front transverse member 36 and terminates in an inverted, Y-portion having one branch 42 fixed to the center of the rear transverse member 38. The front transverse member 36 includes a cylindrical tube 44 having a pair of end caps 46, 48 mounted for rotation thereon. The end caps 46, 48 may function as wheels when stepper 10 is lifted from the rear and moved while the front transverse member 36 supports a stepper 10. The bottom of the rear transverse member 38 is provided with a rotatable adjustment device 50 to slightly change the vertical position at the rear of the stepper 10, if desired. A leg 52 of the inverted Y-portion extends upwardly and forwardly and is integrally formed with a downwardly and forwardly projecting section 54 which supports a seat tube 56.

Slidably supported on the seat 56 is a saddle 58 to which is mounted a seat bottom 60 provided with a pair of grab handles 62, 64 laterally thereof. Also attached to the saddle 58 is a framework 66 for supporting a seat back 68. Although not shown, the saddle 58 includes an adjustment mechanism to permit sliding adjustment of the seat 14 depending on the size of the exerciser. For optimum cardiovascular results, the seat 14 is designed to be placed at a height such that the exerciser's heart is located above the lower body lever arrangements 16, 18.

To add rigidity and stability to the stepper 10, the frame 12 also includes a pair of parallel, vertical support plates 70, 72, attached at a front end on either side of a curved support arm 74 for positioning a control panel 76 forwardly of the seat 14. The support plates 70, 72 are connected at a rear end to the seat supporting section 54. A flat foot plate 78 is mounted rigidly on top of the vertical support plates 70, 72 and includes an inclined foot rest 80 at its forward end and a rear upstanding wall 82 at its rearward end.

Each of the right and left lower body lever arrangements 16, 18 are identical in structure and, as such , only the left lower body lever arrangement 18 will be described.

Figure 3:
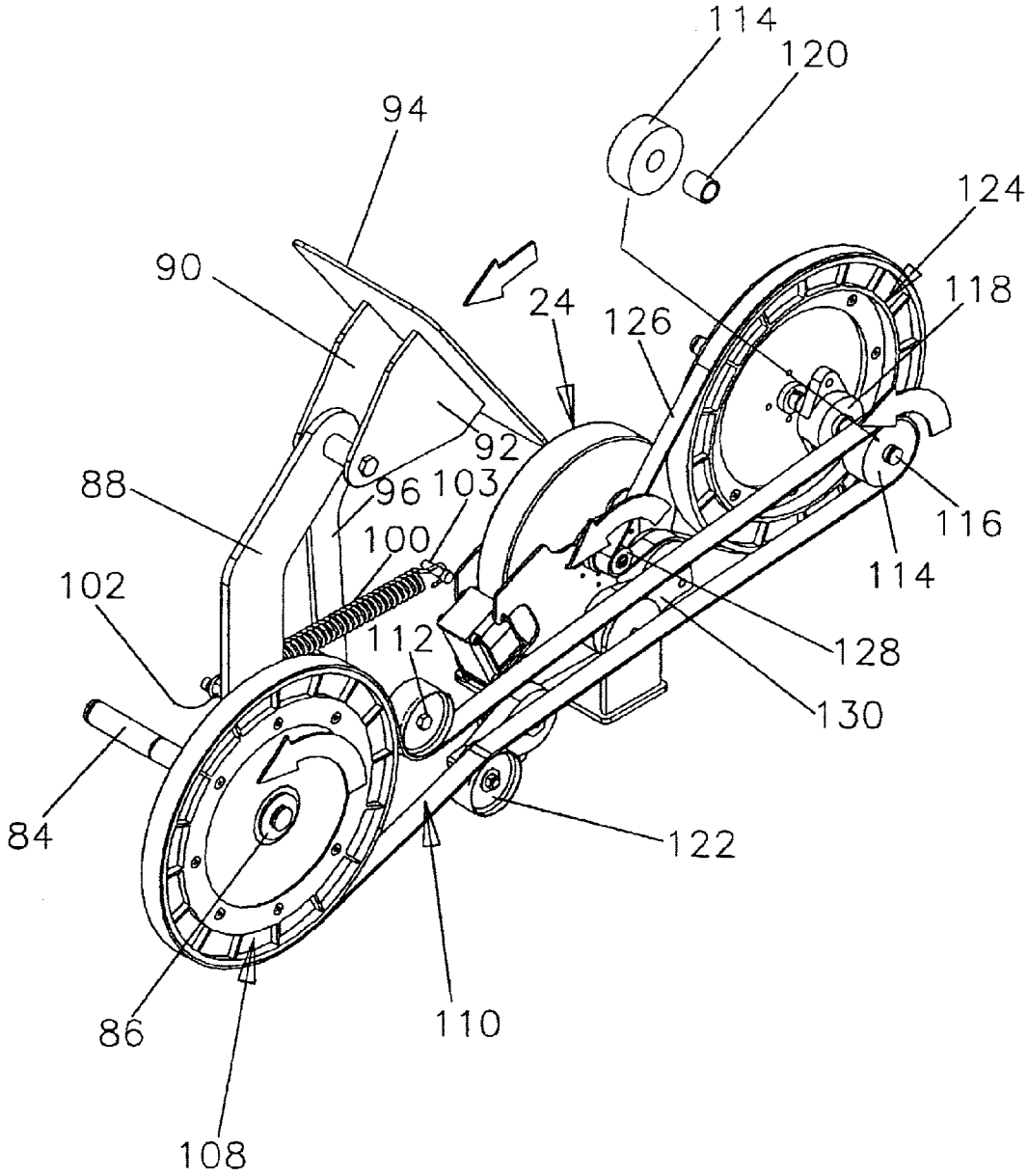
FIG. 3 is an enlarged, fragmentary, perspective view of a motion transfer system for one of the lower body lever arrangements.
Figure 4:
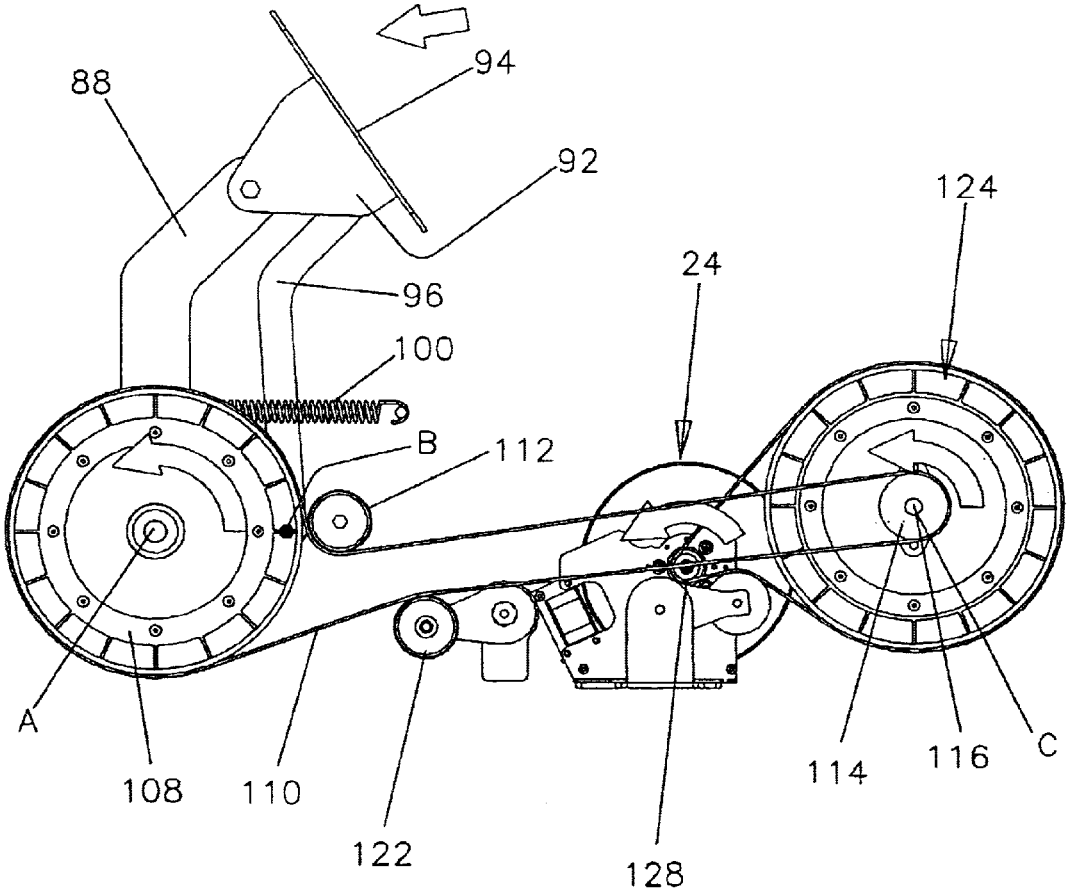
FIG. 4 is a front elevational view of the stepper shown in FIG. 3.
Figure 5:
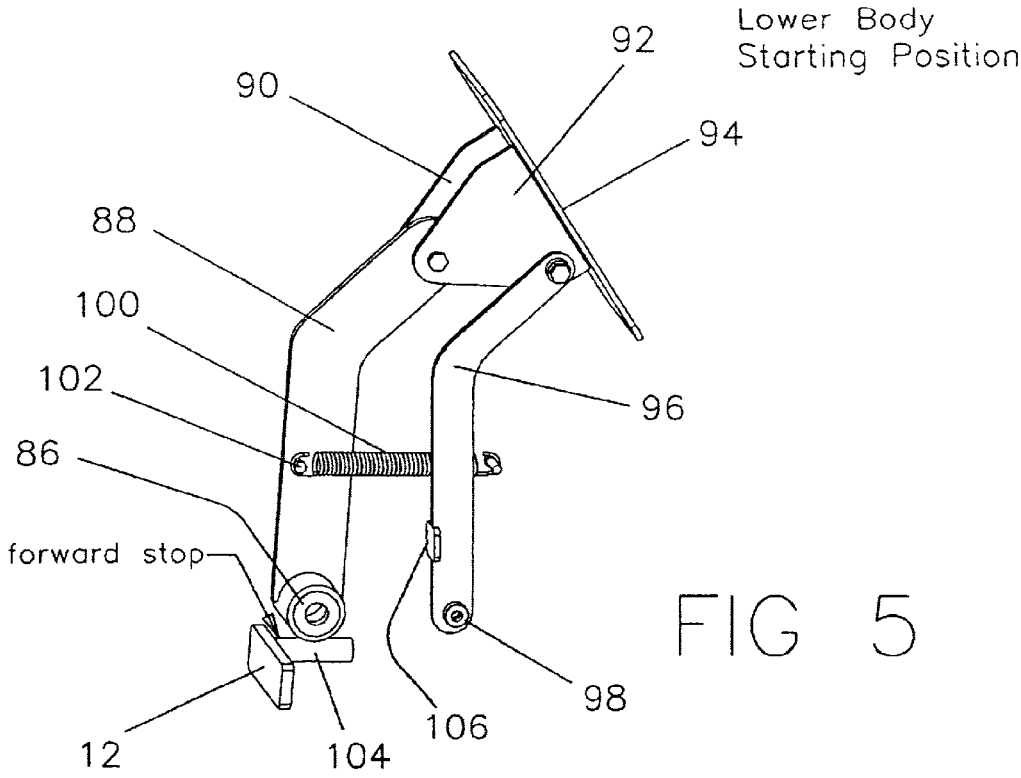
FIGS. 5 and 6 are diagrammatic views of a lower body lever arrangement in starting and finishing positions respectively.
Figure 6:
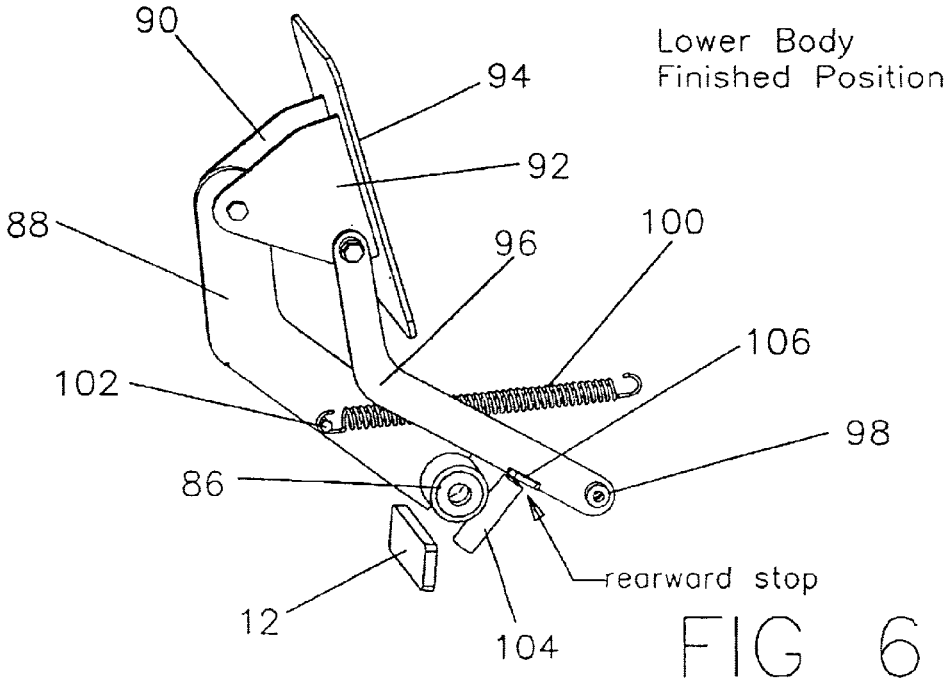
Figure 7:
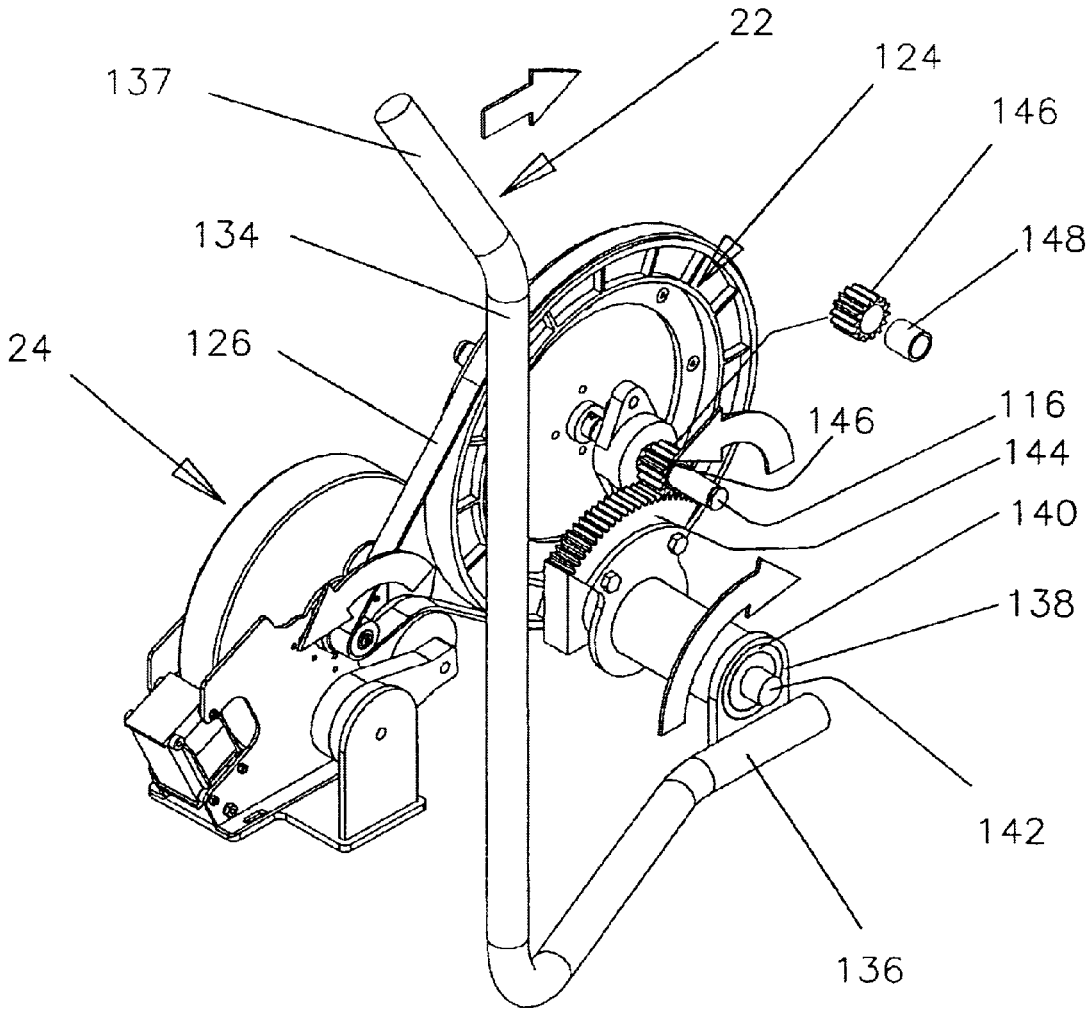
FIG. 7 is an enlarged, fragmentary, perspective view of a motion transfer system for one of the upper body lever arrangements.
Figure 8:
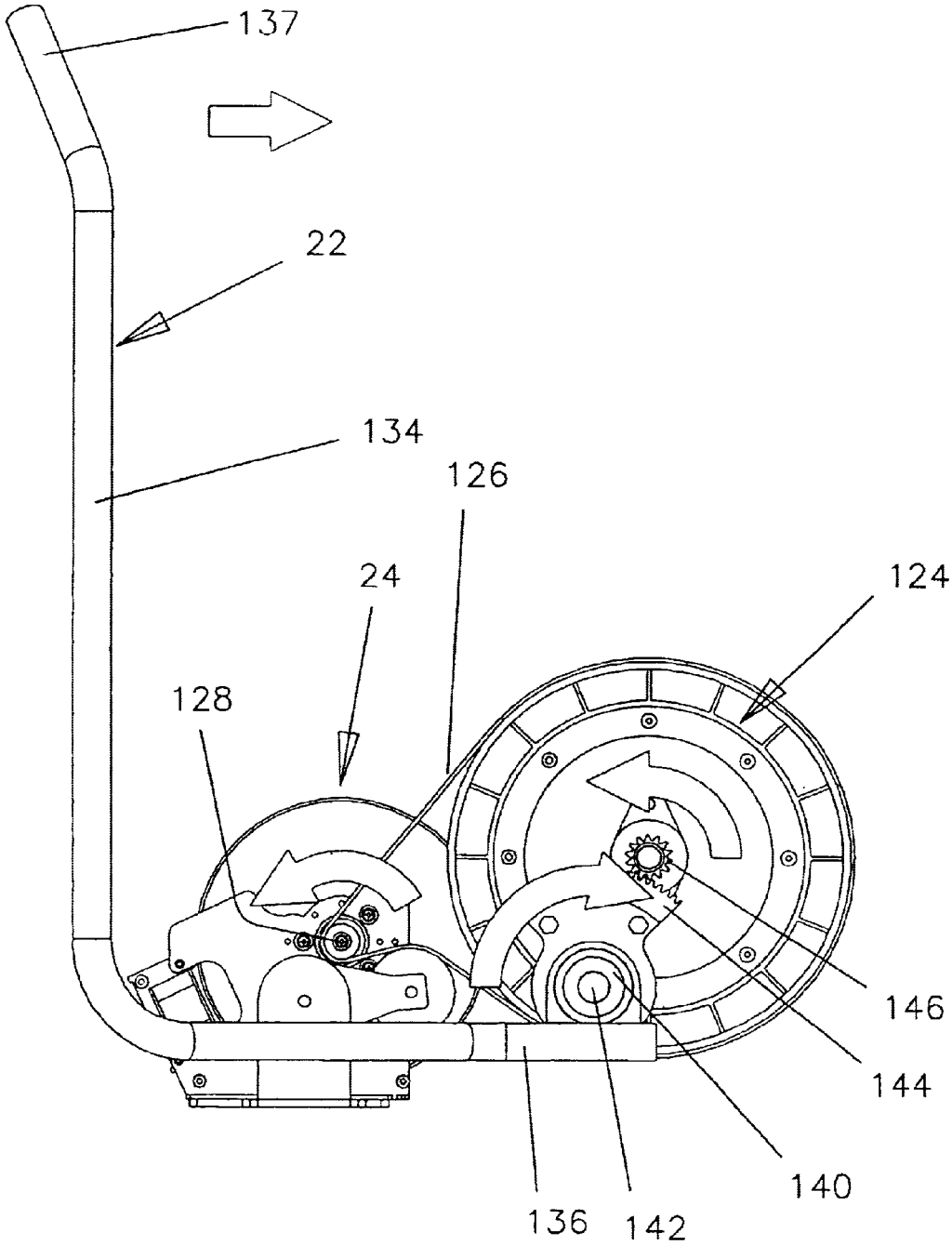
FIG. 8 is a front elevational view of the stepper shown in FIG. 7.

Referring to FIGS. 1 through 6, the left lower body lever arrangement 18 includes at its front end, a shaft 84 which is passed through and fixed to the vertical support plates 70, 72. A cylindrical bearing tube 86 is mounted for rotation on the shaft 84 and provides a pivotal mounting about a pivot axis A for a lower end of a lower body primary lever arm 88. As seen best in FIGS. 5 and 6, the primary lever arm 88 extends upwardly and rearwardly and has an upper end pivotally connected between two ears 90, 92 projecting from a planar foot plate 94 disposed at an incline to an exerciser position in the seat 14. A secondary lever arm 96 configured like primary lever arm 88 but smaller in size, has a lower end pivotally joined about a shaft 98 defining a pivot axis B to one of the vertical support plates 70, 72 of the frame 12. An upper end of the secondary lever arm 96 is swingably attached to a bottom of ear 92. A coil spring 100 has a distal end secured to a first support rod 102 projecting inwardly from the primary lever arm 88, and a proximal end joined to a second support rod 103 mounted to the rear of the inclined foot rest 80 (FIG. 3). As will be appreciated, the spring 100 enables the foot plate 94 to be returned to its original or forward position following a pushing movement by the exerciser's feet and legs. The secondary lever arm 96 is pivotally arranged in such a way so as to control the angle of the foot plate 94 relative to the rotational position of the primary lever arm 88. Stops are provided to limit the rotational travel of the primary lever arm 88 in opposite directions. In particular, a piece of bar stock 104 is welded to a bottom of the bearing tube 86 and has one end which normally engages a portion of the frame 12 in a forward or starting position (FIG. 5). The other end of the bar stock 104 is engagable with a stop surface 106 carried on the movable secondary lever arm 96 in a rearward or finishing position (FIG. 6).

Each of the right and left lower body motion transfer systems 26, 28 are employed to transfer motion from the left and right lower body lever arrangements 16, 18 to the resistance structure 24. Each of the right and left lower body motion transfer systems 26, 28 are identical in structure so that only the left lower body motion transfer system 28 will be described.

Lower body motion transfer system 28 includes a main pulley 108 which is mounted for rotation about pivot axis A with the bearing tube 86 at a location outboard of the lever arms 88, 96. A main drive belt 110 is entrained about the main pulley 108 and passes under an idler pulley 112 which is attached to the frame 12. An upper run of drive belt 110 extends rearwardly and is wrapped about a rotatable driven pulley 114 mounted about a pivot axis C on a drive shaft 116 which is rotatably mounted in a bearing 118 attached to one of the vertical plates 70, 72. Driven pulley 114 has a one-way clutch 120 installed inside in such a way that when rotated in one direction, drive shaft 116 is caused to be rotated, but when rotated in the other direction, the clutch 120 slips and no torque is applied to the drive shaft 116. A lower run of drive belt 110 travels forwardly and passes over a belt tensioner 122 connected to frame 12 to keep the main drive belt 110 taut at all times.

Also included in the motion transfer system 28 is a generator pulley 124 which is mounted for rotation on the drive shaft 116. The generator pulley 124 is connected by a generator drive belt 126 to a rotatable spool 128 of the resistance structure 124. A belt tensioner 130 is attached to the frame 12, and is used to remove any lash from the belt 126. The resistance structure 124 preferably takes the form of a single eddy current brake. Such a brake is commercially available from Chi-Hua Fitness Co. Ltd. of Taipei, Taiwan and sold under model B 6001. The eddy current brake is electronically connected to a control circuit board 132 (FIG. 2) located on the frame 12 behind the main pulley 108. The circuit board 132 is, in turn, connected to the control panel 76 where the exerciser may vary the resistance applied during exercise. It should be understood that other types of resistance structure 24 may also be employed in lieu of the eddy current brake.

When the exerciser pushes the foot plate 94 rearward with his foot, the lower body primary lever arm 88 rotates rearward, turning the lower body main pulley 108 in a circular, counterclockwise direction. This motion pulls the belt 110 causing the driven pulley 114 to rotate also in a counterclockwise direction. When the driven pulley 114 rotates in this direction, the one-way clutch 120 causes the drive shaft 116 to rotate, turning the generator pulley 124 which is affixed to the drive shaft 116 and operably connected to the eddy current brake 24. When the exerciser reaches the limit of extension with his leg, he returns his leg to a bent position. Spring 100 causes the foot plate 94 to return to the forward position. The main pulley 108 is caused to rotate when the foot plate 94 is returned, but no torque is applied to the drive shaft 116 because of the one-way clutch 120. The eddy current brake 24 is electronically controlled by the exerciser to produce resistance to the rotation of the generator pulley 124 causing more pressure to be required by the exerciser to press the foot plate 94 into the rearward position. The arrangement with the right leg operation of the unit is a mirror of the left leg. Because both sides of the unit are connected to the drive shaft 116 with separate one-way clutches 120, they operate independent of each other. With this arrangement, the foot plates 94 can be pressed in alternate motion, or pressed together.

Each of the right and left upper body lever arrangements 20, 22 are identical in structure as are the right and left upper body motion transfer systems 30, 32 so that only the left upper body lever arrangement 22 and the left upper body motion transfer system 32 will be described.

Referring now to FIGS. 1, 2, 7 and 8, the upper body lever arrangement 22 includes an upper body lever arrangement 134 having at its lower end, a horizontal segment 136 which juts outwardly and then curves vertically upwardly terminating in a forwardly projecting handle 137 designed to be within arm's reach of the seated exerciser. As part of the motion transfer system 32, the lower end of the lever 134 is formed with a connector 138 which is joined to a bearing tube 140 rotationally mounted on a shaft 142 projecting from frame 12. That is, a lever arrangement 134 is pivotally mounted about a pivot axis D. A main drive gear 144 is also attached to the bearing tube 140. A driven gear 146 is meshed to the main drive gear 144 and has installed in it a separate one-way clutch 148 such that when rotated in one direction, drive shaft 116 is rotated, but when rotated in the other direction, no torque is applied to the drive shaft 116.

When the exerciser pulls the upper body lever arm 134 back, the main drive gear 144 is rotated, causing the driven gear 146 to rotate the drive shaft 116 and the generator pulley 124. When the exerciser returns the upper body lever 134 to the starting position, the one-way clutch 148 and the driven gear 146 slips and therefore applies no torque to the drive shaft 116. The generator pulley 124 turns eddy current brake 24 which controls resistance the exerciser feels while pulling the upper body lever arm 134.

The arrangement for the right arm is a mirror of the left arm. Because both sides of the unit are connected to the drive shaft 116 with separate one-way clutches 148, they operate independent of each other. With this arrangement, the upper body lever arms 134 can be pulled in an alternate motion or pulled together.

As previously mentioned, the stepper 10 includes a control panel 76 which is programmed so that it will provide information to the exerciser with respect to distance traveled, time elapsed, speed (RPM) and resistance. The exerciser may control certain or all of these parameters by a touch type screen. The control panel 76 can be powered by a battery (not shown) mounted on the frame 12 in the vicinity of the circuit board 132.

It should now be appreciated that the present invention provides a recumbent stepper wherein each of the lever arrangements is completely independent of the remaining lever arrangements so that the exerciser can vary the arm and leg patterns as desired.

While the invention has been described with reference to a preferred embodiment, those skilled in the art will appreciate that certain substitutions, alternations and omissions may be made without departing from the spirit thereof. Accordingly, the foregoing description is meant to be exemplary only, and should not be deemed limitative on the scope of the invention set forth with the following claims.

We claim:

1. A recumbent stepper for exercising the lower body and the upper body comprising:

a frame;

a seat attached to the frame;

first and second lower body lever arrangements pivotally coupled to the frame to move in first and second opposite directions and adapted to be engaged by an exerciser's feet;

first and second upper body lever arrangements pivotally coupled to the frame to move in the first and second directions and adapted to be engaged by an exerciser's arms;

resistance structure commonly connected to each of the lever arrangements for resisting pivoting movement of each lever arrangement in one of the first and second directions; and motion transfer structure mounted on the frame and coupled to each of the lever arrangements and the resistance structure for enabling independent movement of each lever arrangement relative to the remaining lever arrangements.

2. The recumbent stepper of claim 1, wherein the lower body lever arrangements are provided with stop structure for limiting movement in the first and second directions.

3. The recumbent stepper of claim 1, wherein a spring is connected between each lower body lever arrangement and the frame to return each lower body lever arrangement in the second direction.

4. The recumbent stepper of claim 1, wherein the frame includes a pair of spaced apart, vertical support plates extending substantially longitudinally along a length thereof.

5. The recumbent stepper of claim 1, wherein the lower body lever arrangements are pivotally coupled to a frame about first and second pivot axes extending transverse to the frame at a forward end thereof.

6. The recumbent stepper of claim 5, wherein the upper body lever arrangements are pivotally coupled to the frame about a third pivot axis parallel to and rearwardly of the first and second pivot axes and located beneath the seat.

7. The recumbent stepper of claim 6, wherein the motion transfer structure includes a main pulley mounted for rotation about the first pivot axis on each side of the frame at the forward end thereof.

8. The recumbent stepper of claim 7, wherein the motion transfer structure also includes a generator pulley mounted for rotation on a shaft passing through the frame and defining a fourth pivot axis located upwardly and rearwardly of the third pivot axis, the generator pulley being operably connected to the resistance structure.

9. The recumbent stepper of claim 8, wherein the motion transfer structure includes a driven pulley mounted for rotation on the shaft on each side of the generator pulley and provided with a one-way clutch therein, each driven pulley being connected to one of the main pulleys.

10. The recumbent stepper of claim 9, wherein the motion transfer structure further includes a driven gear mounted for rotation on the shaft on each side of the generator pulley between the generator pulley and one of the driven pulleys and provided with a one-way clutch therein.

11. The recumbent stepper of claim 10, wherein each of the upper body lever arrangements has a drive gear in meshing engagement with one of the driven gears.

12. The recumbent stepper of claim 1, wherein the motion transfer structure includes a separate one-way clutch associated with each of the lower body and upper body lever arrangements.

13. In a recumbent stepper having a frame, a seat mounted on the frame, lower body and upper body lever arrangements pivotally coupled to the frame to move in first and second directions and resistance structure for resisting movement of the lever arrangements in one of the first and second directions, the improvement comprising:

a generator pulley mounted for rotation about a shaft passing through the frame and operably connected to the resistance structure;

a driven pulley mounted for rotation on the shaft on each side of the generator pulley and provided with a one-way clutch therein, each driven pulley being operably connected with one of the lower body lever arrangements;

a driven gear mounted for rotation on the shaft on each side of the generator pulley between the generator pulley and one of the driven pulleys, and provided with a one-way clutch therein, each driven gear being operably connected with one of the upper body lever arrangements, whereby movement of each lower body lever arrangement in the first direction causes the driven pulley to rotate on the shaft such that the one-way clutch inside the driven pulley will cause the shaft to rotate turning the generator pulley which is attached to the resistance structure, and movement of the lower body lever arrangement in the second direction prevents rotation of the shaft due to the one-way clutch in the driven pulley, and whereby movement of each upper body lever arrangement in the first direction causes rotation of the driven gear on the shaft such that the one way clutch inside the driven gear will cause the shaft to rotate turning the generator pulley which is attached to the resistance structure, and movement of the upper body lever arrangement in the second direction prevents rotation of the shaft due to the one-way clutch inside the driven gear.

14. A recumbent stepper comprising:

a frame;

a seat attached to the frame;

first and second lower body lever arrangements pivotally coupled to the frame about respective spaced apart, first and second pivot axes located forwardly of the seat to move in first and second directions;

first and second upper body lever arrangements pivotally coupled to the frame about a third pivot axis beneath the seat to move in the first and second directions;

a pair of main pulleys, each mounted for rotation about the first pivot axis at a forward end of the frame;

a generator pulley mounted for rotation about a fourth pivot axis located upwardly and rearwardly of the third pivot axis;

a pair of driven pulleys, one being mounted on each side of the generator pulley about the fourth pivot axis, each driven pulley having a one-way clutch installed therein;

a pair of drive belts, each entrained about one of the main pulleys and one of the driven pulleys on each side of the generator pulley for transferring motion from the lower body lever arrangements to the generator pulley;

a pair of driven gears, each being mounted for rotation about the fourth pivot axis between the generator pulley and one of the driven pulleys, each of the driven gears having a one-way clutch installed therein;

each of the upper body lever arrangements including a main drive gear mounted for rotation about the third pivot axis and a meshing engagement with one of the driven gears;

resistance structure for resisting pivoting movement of each of the lever arrangements in one of the first and second directions; and a generator belt wrapped around the generator pulley and the resistance structure, whereby each of the lever arrangements is enabled to be moved independently or in any combination with the remaining lever arrangements.

* * * * *